US005334061A

United States Patent [19]

Behm et al.

[11] Patent Number: 5,334,061

[45] Date of Patent: Aug. 2, 1994

[54] REVERSING MARINE GAS TURBINE DRIVE

[75] Inventors: Michael E. Behm; Clifford M. Toraason, both of Cincinnati, Ohio

[73] Assignee: General Electric Company, Cincinnati, Ohio

[21] Appl. No.: 942,231

[22] Filed: Sep. 9, 1992

[51] Int. Cl.[5] ..... B63H 21/16; B63H 23/08

[52] U.S. Cl. ..... 440/75; 60/39.162; 74/DIG. 5

[58] Field of Search ..... 440/4, 75; 60/39.162, 60/39.163, 39.12, 39.161; 74/DIG. 5

[56] References Cited

U.S. PATENT DOCUMENTS

| | | | |
|---|---|---|---|
| 663,715 | 12/1900 | Ashton | 415/61 |
| 961,017 | 6/1910 | Riggs | 415/61 |
| 1,016,080 | 1/1912 | McCulloch | 415/61 |
| 1,604,730 | 10/1926 | Weyer | 415/61 |
| 1,845,955 | 2/1932 | Bonom | 415/61 |
| 2,741,351 | 4/1956 | Fletcher et al. | 440/75 X |
| 3,038,307 | 6/1962 | Oprecht | 60/39.161 |
| 4,936,748 | 6/1990 | Adamson et al. | 416/123 |

*Primary Examiner*—Sherman Basinger

*Attorney, Agent, or Firm*—Jerome C. Squillaro; Charles L. Moore, Jr.

[57] ABSTRACT

A reversing marine drive utilizing a gas generator prime mover provided with first and second counter-rotating power turbines. The first turbine is connectable by a differential gear set and a pinion and reduction gear assembly to the ship's shaft to drive the shaft and the screw thereon in the forward thrust direction. The second turbine is connectable by the differential gear set and the pinion and reduction gear assembly to the ship's shaft to drive it and the screw thereon in the reverse thrust direction. A brake assembly is provided in association with each of the first and second power turbines so that when one of the power turbines is driving the screw, the other power turbine is stopped. A master computer may be provided to control the reversing marine drive.

13 Claims, 6 Drawing Sheets

REVERSING MARINE GAS TURBINE DRIVE

TECHNICAL FIELD

The invention relates to a gas turbine marine drive having the capability of reverse thrust for stopping and maneuvering, and more particularly to such a marine drive having oppositely rotating power turbines, each connectable through appropriate gearing to the ship's shaft to obtain forward or reverse thrust from the screw.

BACKGROUND ART

In the field of marine drives, there has for many years existed the problem of how to easily provide the capability for reverse thrust in ships for stopping, maneuvering and the like.

One option has been to provide a reverse gear which can be shifted to reverse rotation of the screw while the prime mover continues to rotate in its original direction. This is only a viable concept in small sizes, not in the thousands-of-horsepower range.

Another option is to stop and reverse the direction of the prime mover. Some marine diesels do this, as well as do steam turbines which have a few rows of reversing blading. This technique is not easily adaptable, however, to gas turbines.

A third option, and perhaps the option most frequently used in modern ships with gas turbine power, is to provide a variable pitch marine propeller, which will generate forward thrust, reverse thrust, or no thrust, depending upon the blade angle, all the while rotating in the same direction. This option also has a number of drawbacks. These variable pitch screws are complicated and expensive with pitch changing mechanism located in the screw hub and extending through a hollow shaft. The size of the screw hub, alone, results in a three to five percent efficiency penalty. The complexity of these screws results in a maintenance burden. Added to this is the fact that much of the mechanism is located outside the ship and the hollow hydrodynamic shaft is difficult to seal. Finally, there is a compromise in cruise efficiency because of the requirement to vary the blade pitch.

The present invention is directed to a simple means of effectively reversing the screw to generate reverse thrust without the attendant limitations of the existing options described above. The present invention utilizes a gas turbine prime mover provided with first and second low pressure, counter-rotating, power turbines. The first power turbine is operatively connected through appropriate gearing to the ship's shaft so as to provide forward screw rotation. The second power turbine is connected through appropriate gearing to the ship's shaft to provide reverse screw rotation. A brake assembly is provided for each power turbine so that only one of the power turbines effectively drives the ship's shaft at any given time.

The marine drive of the present invention requires no reverse gear. All of the gears in the drive of the present invention are in mesh at all times and are loaded. No reverse blading is necessary, nor the attendant difficulty of redirecting gas from the forward to the reverse blading. A conventional fixed pitch screw with a small hub may be employed without compromise, the screw being designed for optimum efficiency at cruise. All of the directional thrust determining mechanism is located within the ship and maintenance is greatly reduced and simplified. Finally, while it is difficult to seal the flow path gases with a rotating turbine case in an aircraft version of a dual rotation turbine, in a marine drive, 99% of the fuel is burned during forward operation when the turbine case is stationary. Zero-leakage seals may be pressed in place during this time. When reverse operation is desired, these seals are retracted and simple labyrinth seals contain the flow path gases. Leakage is not serious in reverse, as efficiency is not a significant consideration because of the short duty cycle.

DISCLOSURE OF THE INVENTION

According to the invention, there is provided a reversing marine drive utilizing a gas turbine prime mover provided with first and second counter-rotating power turbines. The first power turbine is connected to the sun gear of a planetary differential. The second power turbine is connected to the ring gear of the planetary differential. The carrier of the planetary gears comprises the main power shaft and is connected by means of a pinion and reduction gear assembly to the ship's shaft. A brake assembly is provided for the sun gear shaft and thus the first power turbine and a brake assembly is provided for the ring gear and thus the second power turbine. One brake assembly is locked while the other is released so that the shaft of the ship is either driven in the forward thrust direction by the first power turbine or in the reverse thrust direction by the second power turbine.

DETAILED DESCRIPTION OF THE INVENTION

Figure 1:
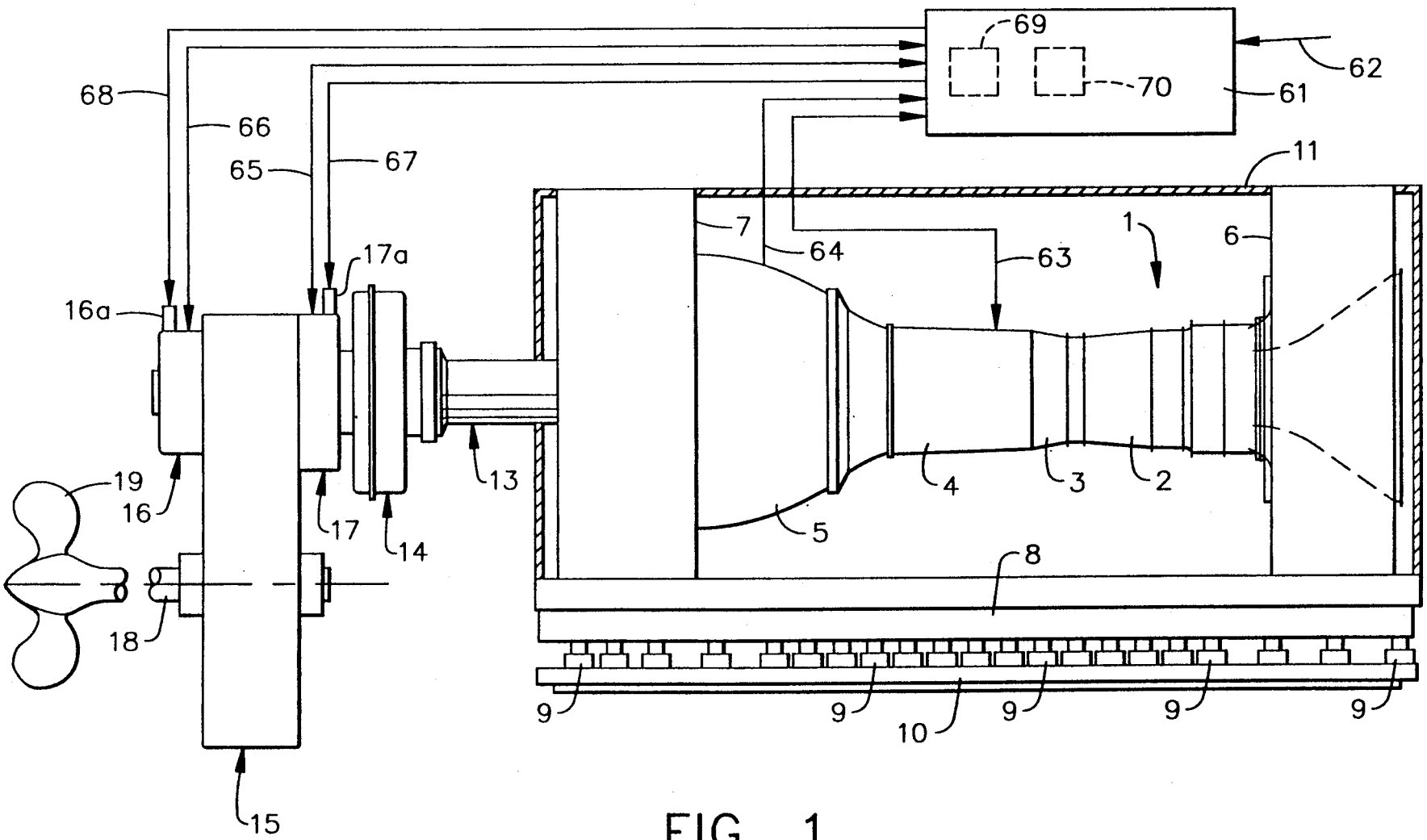
FIG. 1 is a fragmentary, simplified, elevational view, partly in cross-section, of the reversing marine drive of the present invention.

In the figures, like parts have been given like index numerals. Reference is first made to FIG. 1 which is a simplified elevational view of the marine drive of the present invention. The prime mover comprises a gas turbine, generally indicated at 1. The gas turbine has a compressor section 2, a combustor section 3 and a turbine section 4. The compressor section normally houses a low pressure compressor and high pressure compressor. The turbine section normally houses a high pressure turbine to run the high pressure compressor and a low pressure turbine to run the low pressure compressor. The gas turbine engine 1 also includes a power turbine section 5 containing first and second counter-rotating turbines, as will be described hereinafter.

At its forward end, the gas turbine engine 1 is provided with an inlet stack 6. At its aft end, the gas turbine engine 1 is provided with an outlet or exhaust stack 7.

The gas turbine engine assembly just described is mounted on a steel framework 8 provided with a plurality of shock mounts 9, by which the assembly is supported on a base or foundation 10 provided in the ship. The gas turbine engine assembly may have an overall cover or housing 11.

For purposes of an exemplary showing, the prime mover 1 is described and illustrated as being a two-spool gas turbine. It will be understood that the teachings of the present invention would be equally applicable to a single spool gas turbine. Any appropriate gas generator could be used. In fact, a marine boiler could supply steam to drive the power turbines, which would require appropriate reconfiguration, as known in the art.

The first power turbine is connected to a spool shaft which is concentric with and located in a drum shaft operatively connected to the second power turbine. In FIG. 1 the concentric power turbine output shafts are generally indicated at 13. The marine drive of the present invention also includes a planetary gear set generally indicated at 14, a reduction gear set generally indicated at 15, a brake set operatively connected to the first power turbine and generally indicated at 16, and a brake set operatively connected to the second power turbine, generally indicated at 17.

To complete the assembly, the ship's shaft is shown at 18, supporting the propeller or screw 19.

Gas turbine engines provided with a pair of counter-rotating power turbines are known in the art. For example, U.S. Pat. No. 4,936,748 illustrates several embodiments of such an engine, for aircraft use, wherein the dual, counter.-rotating power turbines are used to drive propeller blades, as well as other auxiliary mechanisms. An engine of this general type, for example, is manufactured by the General Electric Company of Evandale, Ohio, under the designation GE36.

Figure 2A:
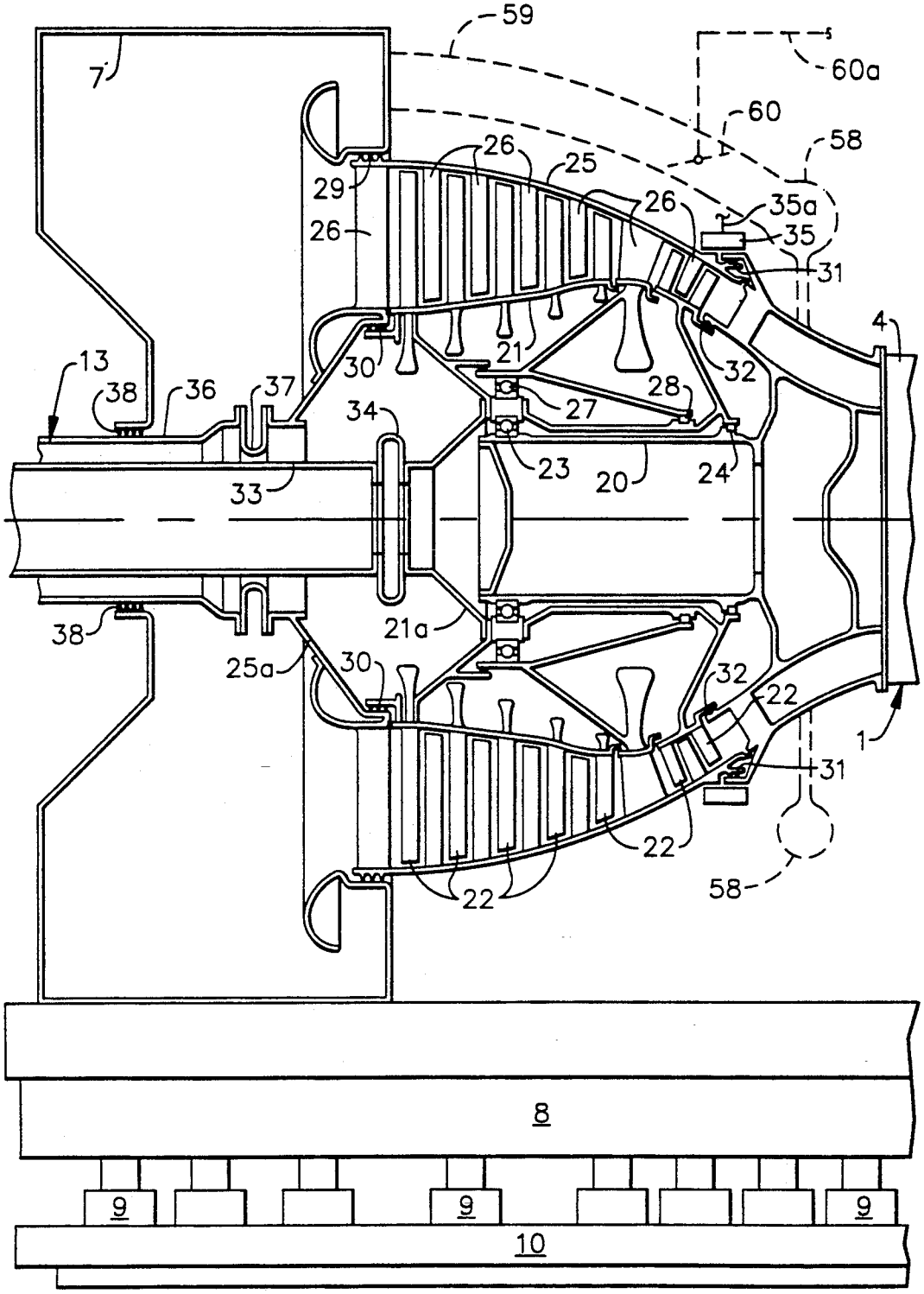
FIG. 2A is a simplified, fragmentary, cross-sectional view of the counter-rotating first and second power turbines and their connections to the spool shaft and drum shaft, respectively.

Reference is made to the FIG. 2A, a simplified cross-sectional view of the power turbine section 5 of gas turbine engine 1. The power turbine section 5 is attached to the outlet end of turbine section 4 of the core engine 1. The power turbine section leads to the outlet or exhaust stack 7. Within the power turbine section 5, there is a stationary cylindrical body of revolution 20 constituting a portion of the aft support framework of the engine 1. A first power turbine 21, having blades 22, is rotatively mounted on the support 20 by bearings 23 and 24. A second power turbine 25, having blades 26, is rotatively mounted on first power turbine by appropriate bearings 27 and 28. Appropriate seals are provided, such as those shown at 29, 30, 31 and 32.

The construction just described is of particular significance. As is well known in the art, bearings such as bearings 23, 24, 27 and 28 are at risk if held stationary for any length of time while being subjected to considerable vibration. Each of the balls or rollers of the bearings pounds on its race at one spot thereon and in a very short time the bearing is rendered unusable. This problem is solved by virtue of the fact that bearings 27 and 28 will always be in motion so long as one of the first power turbine 21 or second power turbine 25 is running. As will be apparent hereinafter, the first power turbine 21 will be stopped when the vessel is in reverse and bearings 23 and 24 will also be fully stopped. Bearings 23 and 24 should not be at risk under these circumstances, however, because of the short duty cycle in reverse mode. When in port with the vessel stopped, but the turbine engine running, (as it might for auxiliary power, exhaust gas waste heat extraction, bleed air extraction, etc.) bearing protection can be afforded by either of two modes. At idle power, the second power turbine 25 could be locked against rotation, with the first power turbine 21 rotating and causing the ship's screw to creep in the forward direction (which would also prevent slack in the mooring lines). Alternatively, both power turbines 21 and 25 could be made free to rotate (the power turbine 25 rotating in a direction opposite to that of power turbine 21).

A body of revolution 21*a* is affixed to the first power turbine 21. The body of revolution 21*a*, in turn, is affixed to spool shaft 33 by means of flexible coupling 34. In similar fashion, a body of revolution 25*a* is affixed to the second power turbine 25. The body of revolution 25*a* is affixed to a drum shaft 36 by means of flexible coupling 37. It will be noted that the spool shaft 33 is coaxial with drum shaft 36 and passes therethrough. An appropriate seal is provided between drum shaft 36 and exhaust stack 7 at 38.

Figure 2B:
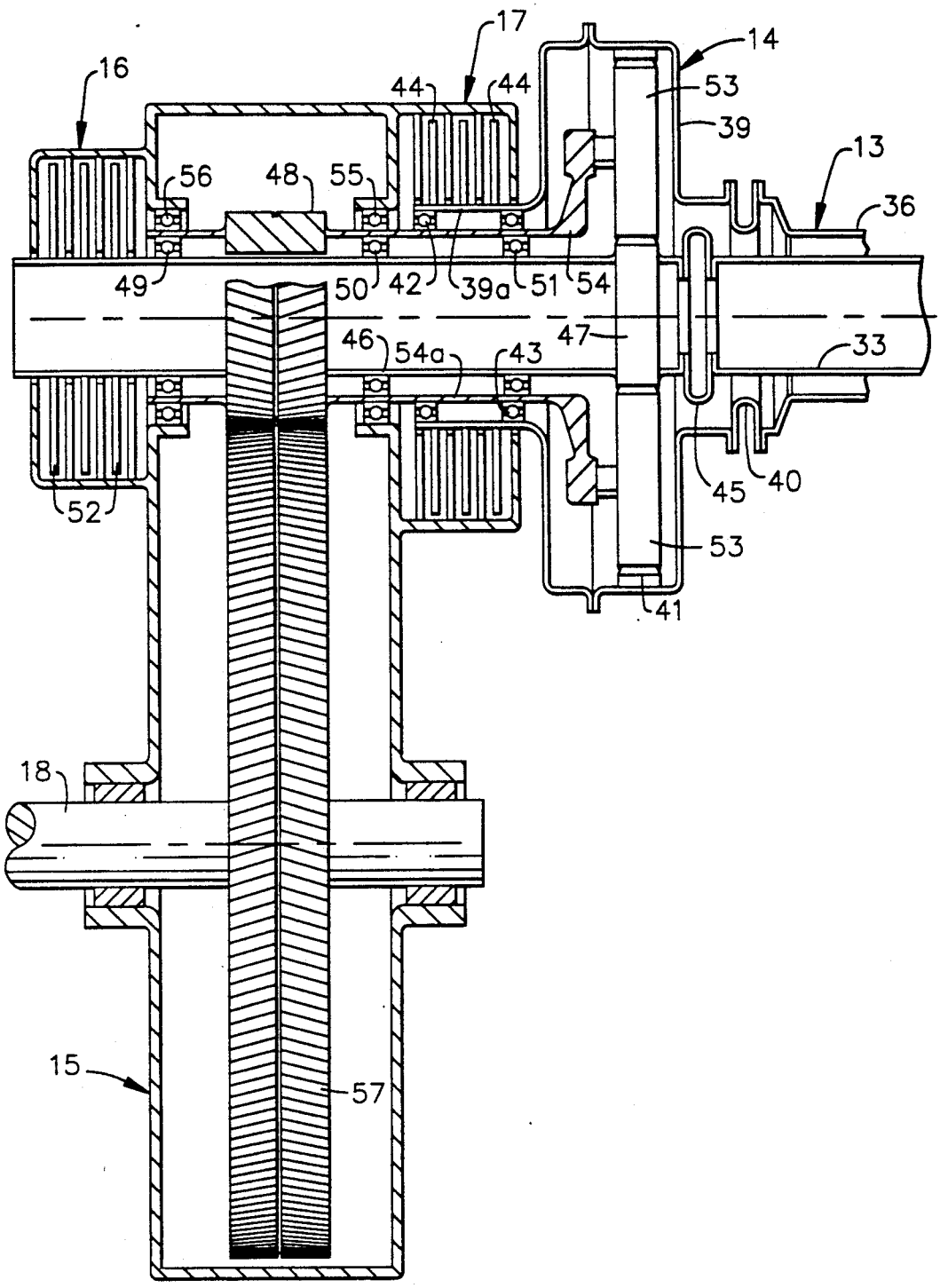
FIG. 2B is a simplified, fragmentary, cross-sectional view, constituting a continuation of FIG. 2A, and illustrating the planetary differential, the reduction gear housing, the brake housings and the shaft of the ship.

Reference is now made to FIG. 2B. As will be apparent from a comparison with FIG. 1, FIG. 2B constitutes a continuation of FIG. 2A.

It will be noted from FIG. 2B that the drum shaft 36 is connected to the housing 39 of the planetary gear set 14 by flexible coupling 40. Housing 39 supports ring gear 41. The aft portion of the planetary gear set housing 39 terminates in a cylindrical shaft-like portion 39*a* supported on bearings 42 and 43. The planetary gear set housing portion 39*a* carries a plurality of brake disks 44, comprising a part of the brake set 17, to be described further hereinafter. The housing 39 and its shaft-like portion 39*a* constitute a continuation of drum shaft 36 and rotate therewith.

The spool shaft 33 is connected by means of a flexible coupling 45 to a shaft 46 which carries the sun gear 47 of the planetary gear set 14. The sun gear shaft 46 passes, with clearance, through a pinion gear 48. The pinion gear 48 will be more fully described hereinafter. The sun gear shaft 46 is, in essence, a continuation of spool shaft 33, rotates therewith, and is supported by bearings 49, 50 and 51. The end of the sup gear shaft 46 supports a plurality of brake disks 52, constituting a part of brake set 16 to be more fully described hereinafter.

Within planetary gear set 14, the ring gear 41 and the sun gear 47 are interconnected by planetary gears 53. The arrangement of ring gear 41, sun gear 47 and planetary gears 53 is conventional and is clearly shown in simplified form in FIG. 3.

The planetary gears 53 have a carrier 54, the rearward end 54*a* of which comprises a hollow shaft. The shaft 54*a* is supported by bearings 51-43, 50-55, and 49-56.

The planetary gear carrier shaft 54*a* comprises the main power shaft for driving the ship's shaft 18. To this end, shaft 54*a* is affixed to pinion gear 48. Pinion gear 48, in turn, drives the reduction drive gear 57, affixed to the ship shaft 18.

It will be evident from the above description that if the brake set 17 (hereinafter referred to as second power turbine brake) is actuated, and if brake set 16 (hereinafter referred to as first power turbine brake) is unactuated, rotation of the planetary gear set housing 39 and its shaft portion 39*a*, ring gear 41, drum shaft 36 and second power turbine 25 will be precluded. The first power turbine 21 will be free to rotate and will cause rotation of spool shaft 33, sun gear shaft 46 and the sun gear 47. It will be remembered that sun gear shaft 46 passes with clearance through pinion gear 48. With ring gear 41 held stationary, sun gear 47 will cause rotation of planetary gears 53 and their carrier 54, including its shaft-like portion 54*a*. This, in turn, will result in rotation of pinion gear 48, reduction drive gear 57, ship shaft 18 and screw 19. Rotation of the first power turbine 21 is such as to cause the screw 19 to rotate in the forward thrust direction.

If the first power turbine brake 16, is activated, and the second power turbine brake 17 is released, rotation of sun gear shaft 46, sun gear 47, spool shaft 33 and first power turbine 21 will be precluded. The second power turbine 25 is free to rotate, causing rotation of drum shaft 36, planetary gear housing 39 and its portion 39*a*, as well as ring gear 41. With the sun gear 47 held stationary and ring gear 41 rotating, the planetary gears 33 will be caused to rotate. This, in turn, will result in rotation of the planetary gear carrier 54 and its shaft portion 54*a*. This, again results in rotation of pinion gear 48, reduction drive gear 57, ship shaft 18 and screw 19. It will be remembered, however, that the direction of rotation of the second power turbine 25 is opposite that of the first power turbine 21, with the result that the screw 19 will rotate in a rearward thrust direction.

From the above description, it will be understood that the planetary gear set 14 serves both as a differential and as a primary reduction gear, in conjunction with reduction drive gear 57. The gas turbine engine 1 and its dual power turbine section 5 differ from prior art engines of this general type in that when the engine 1 is running at other than idle, only one of the turbines 21 and 25 rotates at any given time, the other turbine being stopped by its respective one of the brake sets 16 and 17. The brake sets 16 and 17 must be capable of holding against very large torques, but are not required to absorb significant energy or to stop a rotating member under significant load.

In FIG. 2B, the first and second power turbine brake sets 16 and 17 are semi-diagramatically illustrated as hydraulically actuated disk brakes. It will be understood that any appropriate type of brake assembly may be employed. It is preferred that a backup lock mechanism (diagramatically indicated at 16*a* and 17*a* in FIG. 1) be provided for each of the brake sets 16 and 17, so that when one of the turbines 21 and 25 is to be precluded from rotation, hydraulic pressure need not ba maintained in its respective brake set once that turbine is stopped. An interlock is preferably provided inhibiting power settings above idle when both brake sets 16 and 17 are released. Similarly, an interlock should be provided to inhibit brake release when the engine power setting is above idle.

It will be remembered that at other than idle speeds, only one of the turbines 21 and 25 will rotate at a given time. If the entry angle of the gasses is designed for best efficiency when the first turbine 21 is driving the ship in the forward mode, it will be understood that this entry angle might not be the best for driving the second turbine 25 to propel the ship in the reverse or astern mode. As will be developed hereinafter, in an emergency reverse situation, the turbine 25 may be caused to rotate in the wrong direction by the screw until the ship has lost sufficient way in the forward direction. There are numerous means and practices well known in the art to improve entry angle and any one of these practices may be applied depending upon the design of the first turbine 21 and second turbine 25, and the severity of the problem. In some instances, it may be sufficient to do nothing, simply accepting a penalty when in the reverse mode. It would be possible, of course, to use variable geometry inlet guide vanes, as are well known in the art. Such variable geometry inlet guide vanes would be capable of inducing plus or minus swirl. If the stage 1 blades are on the first turbine 21 (as shown in FIG. 2A), then these blades are either stopped or moving at plus 100%. If the first stage blades were on the second turbine 25, the situation would be less favorable, as the speed of the first stage blades could then vary from about minus 100%, through stopped, to plus 100%.

It is preferable in the practice of the present invention to provide the entry end of the second turbine 25 with a large diameter gas seal which can be deployed to the contacting, no-leak condition when the second turbine 25 is not rotating. Such a seal is diagramatically indicated at 35 in FIG. 2A. The seal 35 may be shiftable into simultaneous contact with the outer surface of the second turbine 25 and the outer surface of the outlet of the gas turbine 1, or it may be inflatable so as to contact and form a seal with these surfaces. The seal 35 will move out of contact with the surfaces when the second turbine 25 is called upon to rotate. Under these circumstances, sealing in the area in question will be accomplished by labrynth seal 31.

As indicated above, and as will be explained more fully hereinafter, during an emergency reverse process, the first turbine 21 will be stopped and the second turbine 25 may be driven in the wrong direction by the ships screw. Under these circumstances, the ship's screw acts as a turbine, driven by the water while the ship still has forward way at relative high speed. With this back spinning of turbine 25, the gas entry vector diagrams are so inappropriate that if the gas generator 1 is at an inappropriate speed and/or undergoing a transient, compressor stall might occur because the back-spinning turbine may produce unusual flow restriction with resulting back pressure on the gas generator. On the other hand, during an emergency reverse procedure it is desirable to deliver as much reverse power or torque to the screw shaft 18 as early as possible. Therefore, it is desirable to get the gas turbine 1 up to near full power as soon as possible. To accommodate this, it is within the scope of the present invention to provide a waste gate or bypass valve assembly. Such an assembly is shown in broken lines in FIG. 2A. The exhaust outlet of the turbine engine 1 is surrounded by and connected to an annular collection manifold 58. The collection manifold 58 is connected by conduit 59 directly to the exhaust stack 7. The conduit 59 contains a bypass valve 60. In this manner, the gas turbine 1, having been chopped in an emergency reverse process, can be brought back up to near full power as soon as possible and its output exhaust can be diverted about turbine 25 and directly to exhaust stack 7 by means of collecting manifold 58 and conduit 59 with bypass valve 60 open. The bypass valve 60 will be closed as expeditiously as possible (the principal concern being to maintain adequate gas generator stall margin) so that the exhaust output of the gas turbine 1 can assist in reducing the back spinning of turbine 25, causing it to pass through a stopped condition and then begin rotation in the proper direction to cause the ship's screw to move the ship astern.

The reversing marine gas turbine drive of the present invention is provided with a master control in the form of a computer, diagramatically indicated at 61 in FIG. 1. The computer 61 receives inputs from the bridge via the engine room telegraph relating to power setting, forward or reverse direction, and the like. The computer is connected to the gas turbine 1 by appropriate inputs and outputs, generally represented by the line 63 in FIG. 1. The inputs are from sensors on the gas generator 1 relating to speed, temperature, pressure, position of various shiftable elements, and the like, as is well known to one skilled in the art. These inputs enable the computer 61 to at any time know the condition of the elements of the gas turbine 1 relating to the scheduling of fuel flow, the management of variable geometry elements, valving and the like. Additional inputs to the computer 61 are indicated by the single line 64 and relate to indications of power turbine speeds. In addition to the gas turbine parameters, the computer 61 also monitors such variables as screw speed, vessel speed, and shaft torque to permit optimal management. The outputs of the computer to the gas turbine engine 1, also represented by the line 63, control those devices of the gas turbine 1 having to do with fuel flow, valving, cooling and the like. The bypass valve 60 of FIG. 2A is connected via line **60*a* to computer 62 which appropriately controls the opening and closing of the bypass valve 60. Similarly, the seal 35 is controlled by computer 61, as is diagramatically indicated by line 35*a* of FIG. 2A. Computer 61 controls the brake assemblies 16 and 17 through appropriate outputs and senses their position and state through appropriate inputs. These inputs and outputs are generally illustrated in FIG. 1 by the lines 66 and 67. The computer 61 also controls the brake interlocks 16*a* and 17*a*, described above, and used to maintain their respective turbines in stopped condition, once stopped by their respective brakes. Finally, the computer 61 is provided with an interlock circuit diagramatically indicated in broken lines at 69 for inhibiting power settings above idle when both brake sets 16 and 17 are released, as described above. Similarly, the interlock circuit (previously mentioned) to inhibit brake release when the engine power setting is above idle is indicated in broken lines in FIG. 1 at 70**.

Figure 4:
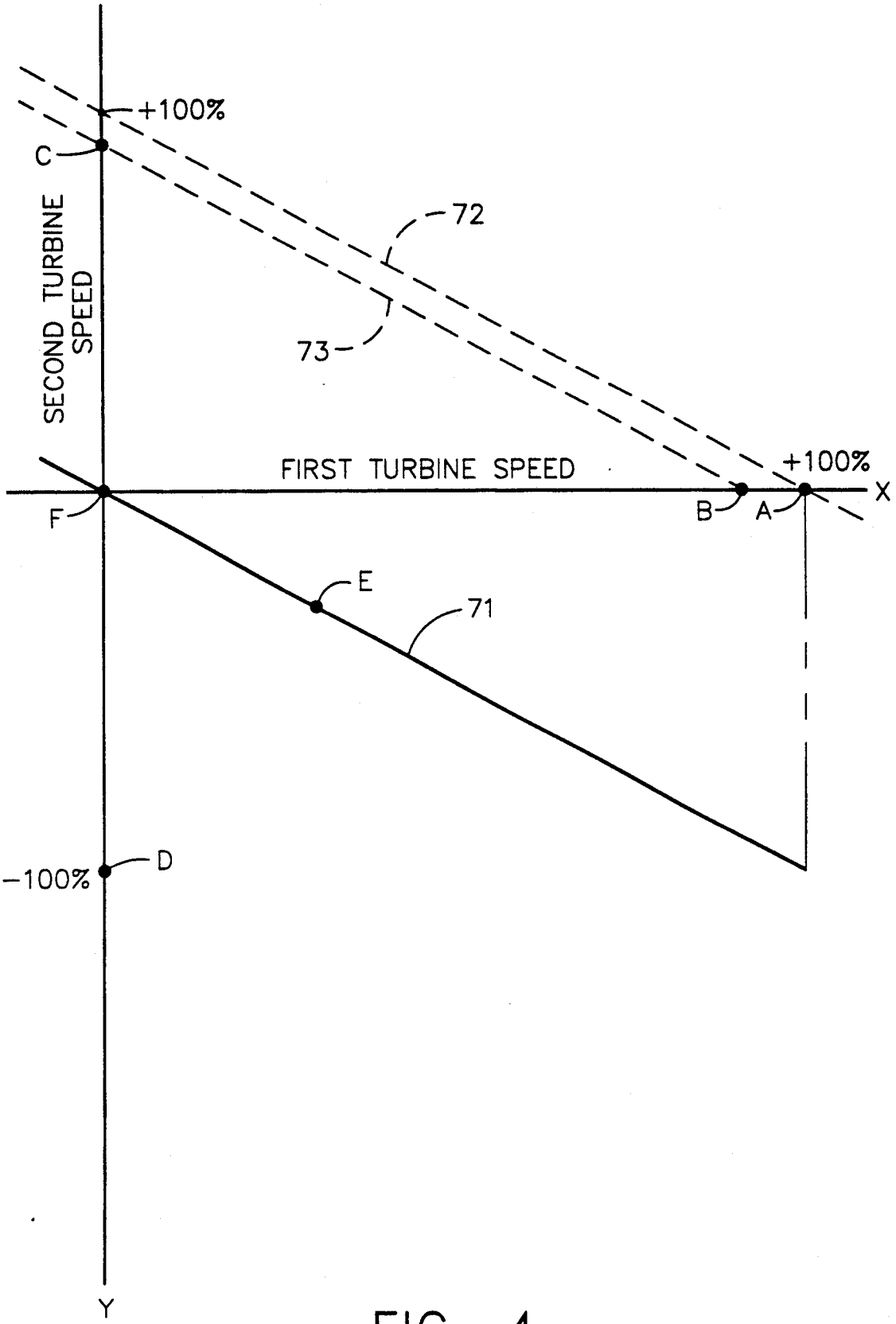
FIG. 4 is a plot describing the speed relationships between the first turbine, the second turbine and the screw of the present invention.

The invention having been described in detail, it's operation can now be set forth. Reference is made to the drawings, and particularly to FIG. 4 which is a plot showing the speed relationships between the first and second turbines and the screw. It is to be noted that positive speed is assumed to be clockwise, while negative speed is assumed to be counterclockwise. FIG. 4 is an explanatory plot only, and is not drawn to scale.

With the engine 1 idling, and the screw 19 stopped, both brakes 16 and 17 are released and the seal 35 (FIG. 2A), if fitted to the machine, is retracted. The first turbine 21 rotates in the ahead direction and the second turbine 25 rotates in the astern direction. Because the gas turbine engine 1 is idling, the speeds of the two turbines 21 and 25 are relatively low, and there is no significant output torque to screw 19. The speed relation is shown by line 71 of FIG. 4 with normal idle indicated at point E on line 71. A no load turbine overspeed is prevented by the interlock 69 that inhibits power settings above idle with both brake sets 16 and 17 released. It will be noted that the line 71 is not at a 45° angle because of the gear ratios of the planetary differential 14 (as will be developed further, hereinafter). It will be understood that a conventional differential could be substituted for the planetary differential. The planetary gear set 14 is preferred because of its strength and because it also serves as a primary reduction gear set.

To shift from an engine idling-screw stopped condition to a getting underway ahead condition, appropriate inputs 62 are received by computer 61 from the bridge. The second power turbine brake 17 is applied by computer 61, stopping second turbine 25. As a result, the turbine speeds will move along line 71 from E to F, because this will tend to stop the first turbine 21 as well. Because of the idling gas turbine engine 1, not much more energy than that required to dissipate the inertia of the rotating parts will be absorbed. The torque applied to the first turbine 21 by the idling gas generated will attempt to rotate the screw 19 at a creep speed. Once the second turbine 25 is stopped and the backup lock **17*a* is energized (if present) by computer 61, the inhibiting interlock 69 will allow engine power setting to be advanced above idle. This will cause the torque of the first turbine 21 to increase and the turbine 21 and spool 19 will begin to accelerate. Speed movement will be along the X axis of FIG. 4 from point F toward point A. At full ahead screw rpm, the speed of the first turbine 21 is at point A and the speed of the second turbine 25 is at point F (i.e. zero). A broken line 72 has been drawn through point A and intersects the Y axis at the same angle as line 71. The line 72** completes the plot envelope.

Getting underway astern from an engine idling/-screw stopped condition is similar to getting underway ahead. In this instance, upon receipt of appropriate inputs 62 from the bridge, the first turbine brake 16 is applied by computer 61 (and locked by backup lock **16*a*, if so equipped), the second turbine brake 17 being in the released condition. Rotation of both turbines 21 and 25 will be arrested, shifting along line 71 from E to F. With the first turbine brake set and locked, the no load turbine overspeed interlock 69 will no longer inhibit power settings above idle, and the second turbine 25 will supply torque to the screw 19 and both will begin to rotate in the astern direction. On the plot of FIG. 4, the speed of the first turbine will be at F (i.e. zero). The speed of the second turbine 25** will shift downwardly along the Y axis toward D.

At full astern screw speed, operation is normally only at point D (the second turbine 25 and the screw rotating in the negative direction, with the first turbine 21 braked to a stop).

Under some circumstances, it may be required to go into emergency reverse from full ahead. In such an instance, the gas turbine engine is chopped to idle by computer 61 upon receipt of appropriate inputs 62 from the bridge. As soon as the speed decays to an appropriate point, the second turbine brake 17 and lock **17*a* (if present) are released by computer 61. It will be remembered that until the gas turbine engine power decays to a suitable level, the above mentioned turbine overspeed prevention interlock 70 will preclude release of brake set 17. When release of brake 17 is accomplished, the second power turbine 25 will back rotate, and the first power turbine speed will drop. Output torque to screw 19** will drop to effectively zero.

Since the ship has way, the screw will continue to rotate, propelled by the water. At high vessel speed, the screw could be motored to near full speed. The screw speed change resulting from the power chop is shown in FIG. 4 as the move from point A to point B. Line 73 of FIG. 4 shows the relation of the speed of the second turbine 25 to the speed of the first turbine 21 at this relatively high screw windmilling rpm. The shift to point B results from taking power out of or absorbing power from the screw 19, using it as a turbine. When the screw 19 serves as a propulsor, there is a slight angle of attack on the screw blades. When the screw 19 is in the turbine mode, the angle of attack on the screw blades will go from slightly positive, through zero, to slightly negative. To make such a change in the vector diagram, there must be migration of speed from A to B in FIG. 4.

Release of the brake set 17 of second turbine 25 by computer 61 will cause the speeds of the first turbine 21 and second turbine 25 to move along line 73 from point B toward point C. As the first turbine 21 slows, the second turbine 25 is turning in a positive direction, opposite the direction the gas generator would have it turn. At this point, there is the possibility of transient torques existing at the instant of release of brake set 17, causing movement to the right along line 73. A number of measures such as early spool brake application or the like could combat this.

Next, the brake set 16 for the first turbine 21, is applied by computer 61 at a predetermined rate. This will further push the turbine speeds along line 73 toward point C. When point C is reached, the first turbine 21 comes to rest, its brake set 16 being fully applied. Even under this extreme operating condition, the brake set 16 has little more to do than absorb the energy of the inertia of the rotors of the first turbine 21. When first turbine 21 is fully stopped, the computer 61 will energize lock 16*a*.

Once point C is reached, the inhibition against power settings above idle is removed since brake set 16 is fully applied. The gas turbine engine 1 is accelerated at a suitable emergency rate. The speed of the second turbine 25 will move from point C toward point F (at which point the screw 19 will be stopped) and then will continue on to point D with the screw 19 at full astern speed.

At the instant of acceleration of the gas turbine engine 1, the second turbine 25 is turning at near full speed in the backward direction. Engine power will slow the backward turning turbine 25, and for an instant at point F, all rotation of all components will be zero. The second turbine 25 will continue to accelerate, passing through-point F, now rotating in its normal powered astern direction. In a system provided with the above described bypass valve assembly, the computer 61 will accelerate the gas turbine 1 early and rapidly, controlling the engine output to the second turbine by means of the bypass valve 60.

Figure 5:
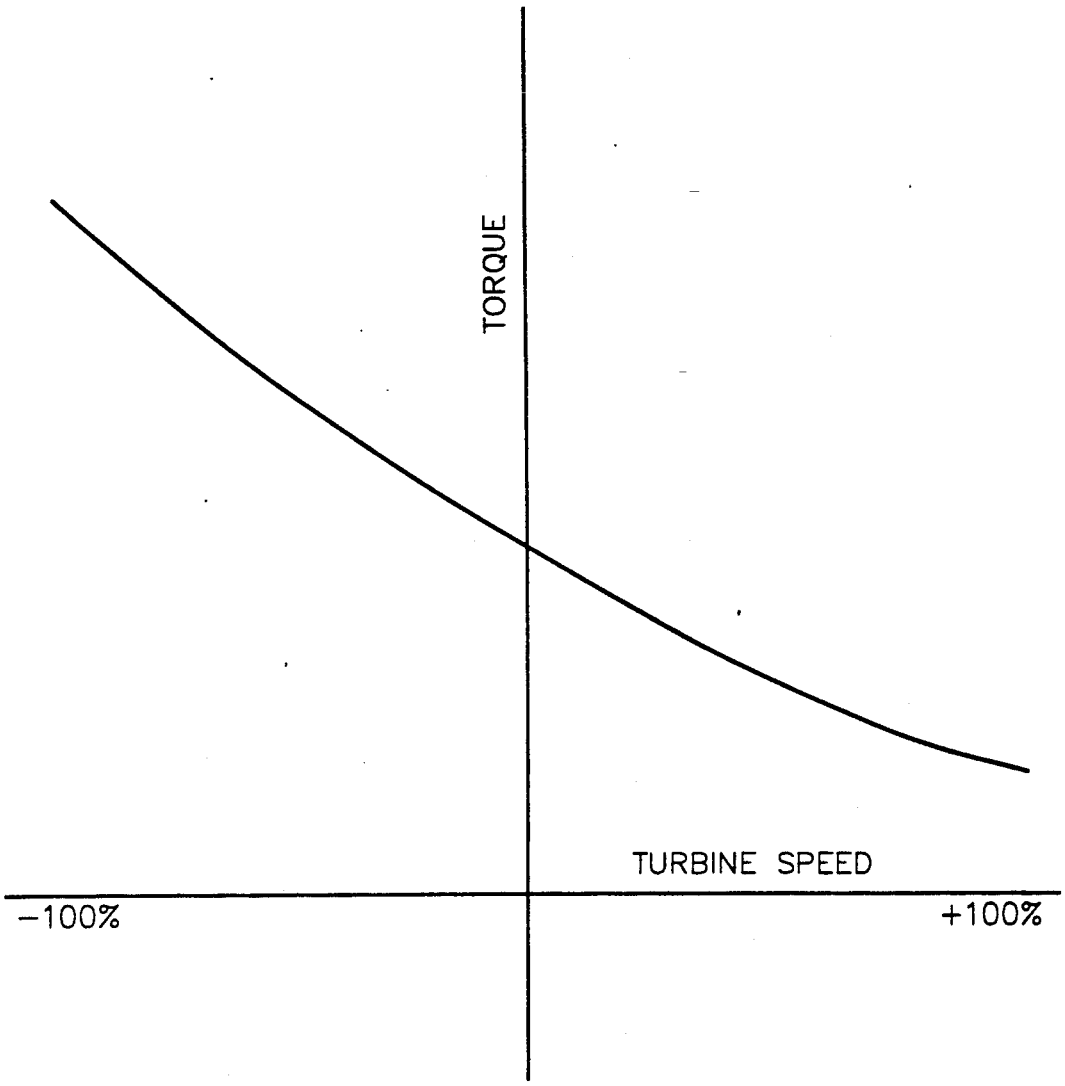
FIG. 5 is a simplified turbine speed/torque curve.

FIG. 5 is a typical turbine speed/torque curve. While not all turbines demonstrate this speed/torque characteristic, a great many do. It will be noted that the slower the speed, the more torque is available. The torque curve continues to rise as the speed passes through zero rpm to negative rpm. This phenomena means that the second turbine 25 will generate significantly more torque as it is braking the reverse windmilling screw to a stop than is available at normal full power. At the time of an emergency reverse, the ship shaft must be provided with more torque than at any other time in the mission cycle because it is desired to stop the forward windmilling direction of the screw and start the screw in the desired reverse direction. By virtue of this phenomena, and if the turbines of the present invention are such as to demonstrate this speed/torque characteristic, under emergency conditions vessel breaking and reversal will be unusually effective.

As indicated above, a conventional differential could be substituted for the planetary differential described above. The planetary differential is preferred, however, for a number of reasons. First of all, it is of relative simple and robust construction, and it also serves as a primary reduction gear set. Furthermore, the planetary differential demonstrates certain characteristics which fit in quite nicely with the requirements of the present invention, as will be apparent hereinafter.

Figure 3:
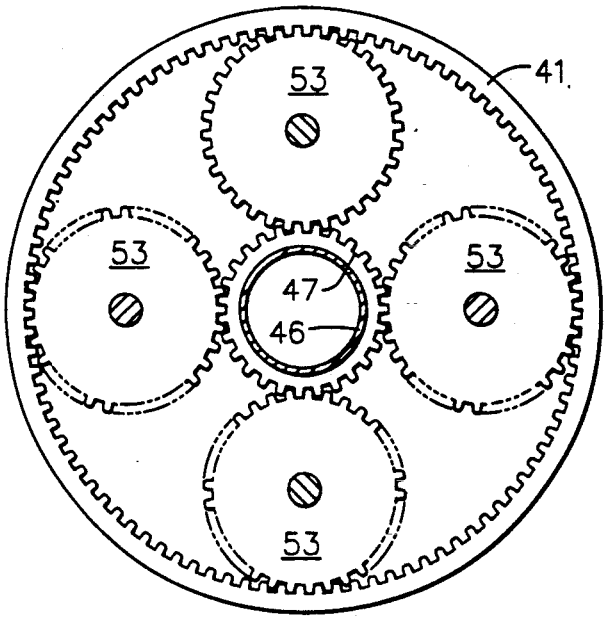
FIG. 3 is a simplified elevational view of the ring, planetary and sun gears of the planetary differential.

To demonstrate the above, reference is made to FIG. 3. For purposes of explanation, let it be assumed that the sun gear 47 and the planetary gears 53 all are of equal diameter. In such an instance, it will be evident that the ring gear 41 would have a diameter equal to three times that of the sun gear or three times that of any one of the planetary gears.

Let it further be assumed that the planetary carrier 54 (see FIG. 2B) is held stationary so that the planetary gears 53 are free to rotate about their axes, but do not orbit. In such an instance, the gears 53 constitute star gears or idler gears. If the sun gear 47 is driven, and the gears 53 act as star or idler gears, they will determine the direction of rotation of the ring gear 41, but they will have no effect on the sun gear to ring gear speed ratio. In the particular example under discussion, wherein all of the gears 47 and 53 are of the same diameter, the speed ratio of the sun gear to the ring gear will obviously be 3/1 since the diameter of the ring gear 41 is three times that of the sun gear 47. As is well known to one skilled in the art, if the ring gear 41 is fixed and the planet carrier 54 is free to rotate, then the speed ratio of the driving sun gear 47 to the driven planet carrier is always one more than the ratio of the sun gear to the ring gear in the star gear situation, i.e. 4/1 in this particular example.

The relationship between the speed of the sun gear, the speed of the ring gear and the speed of the carrier can be plotted. The previously described FIG. 4 was, in fact, just such a plot. It will be remembered that carrier speed is related to screw speed since the carrier drives the screw via gear 48, gear 57 and ship shaft 18.

Figure 6:
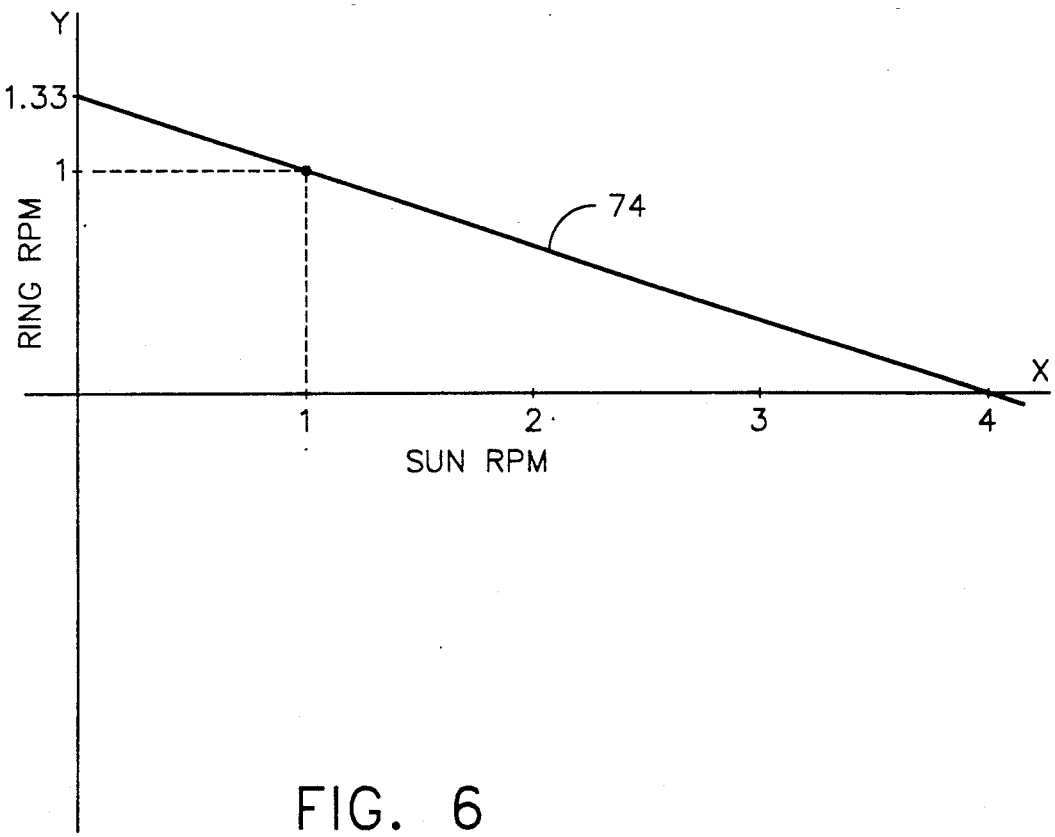
FIG. 6 is a plot of ring gear and sun gear rpm, the slope of which can be used to determine gear sizes of the planetary differential.

FIG. 6 is a plot for the particular example under discussion. In FIG. 6, the X axis represents the sun gear rpm and the Y axis represents the ring gear rpm. The curve 74 is rectilinear and is drawn for 1 rpm carrier speed. At zero carrier speed, the curve 74 would have passed through the intersection of the X and Y axes (i.e. zero). The slope of curve 74 is minus $\frac{1}{3}$ and may be represented by the formula:

$$\text{Slope} = \frac{-D_{sun}}{D_{ring}}$$

Where $D_{sun}$ is the diameter of the sun gear and $D_{ring}$ is the diameter of the ring gear.

In this example, it was determined that the speed ratio of the sun gear to the ring gear was 3/1. It will be noted that the curve 74 intersects the X axis at 4 rpm and the Y axis at 1.33 rpm. 1.33 being $\frac{1}{3}$ of 4. The curve also verifies the 4:1 speed ratio of the sun gear to the carrier, showing 4 sun gear rpm for 1 carrier rpm at zero (locked) ring rpm.

It is evident from FIG. 6 that the torque applied to the screw 19 by the first turbine 21 during forward driving of the ship will be greater than the torque supplied to screw 19 by the second turbine 25 during reverse driving of the ship. With the use of a simple planetary gear set, this will always be the case. If the torque supplied to screw 19 by the first turbine 21 and the torque supplied to the screw 19 by the second turbine 25 were equal, then the slope of FIG. 6 would be minus 1 or 45°. The above-noted formula indicates that for such a slope, the diameter of the sun gear and the diameter of the ring gear would have to be equal, the planetary gears being infinitely small.

The torque disparity indicated by FIG. 6 is, of course, far too great and clearly shows that a planetary gear set with a sun gear and planetary gears of equal diameters would be far from optimum for the purposes of the present invention. The slope of curve 74 should be more nearly toward 45° and the planetary gears should be considerably smaller than the sun gear.

Again, however, all of this works in favor of the present invention. For example, when the screw 19 is driving the ship in reverse, tie pressure side and the suction side of the screw change roles, as do the leading edges and the trailing edges. Both the thrust and the direction of rotation of the screw are different and it must be assumed that the camber of the blade is incorrect for reverse propulsion. Designed for cruise, the configuration of screw 19 will be non-optimum for reverse propulsion. As a consequence, the screw 19 will be less efficient and will act like a smaller screw, pumping less flow per turn. As a consequence, the screw 19 will absorb less horse power for a given rpm (less torque), and the fact that the system of the present invention delivers less torque in reverse than in cruise is, in fact, an appropriate characteristic for this purpose.

The fact that planetary gears should be of a lesser diameter than the sun gear is also advantageous to the practice of the present invention. More planetary gears mean more branches on carrier 54 resulting in high load carrying ability for a given size and weight. For example, doubling the number of branches of carrier 54 doubles its capability, but does not double its size or weight. In fact, the entire planetary system is strengthened since more teeth will be carrying the load at any given time.

From the above, it will be noted that the fact that the planetary system decrees that we have different ratios of turbine rotation to screw rotation in forward and in reverse is, indeed, a benefit, as is the desirability for planetary gears significantly smaller than the sun gear.

In designing the reversing marine gas turbine drive of the present invention, it is desirable to ascertain an ideal mechanical ratio based upon the performance of the second turbine 25 and the performance of the screw 19 in reverse propulsion. Similarly, an ideal mechanical ratio is devised based upon the performance of the first turbine 21 and the screw 19 in forward propulsion. From these ratios, an ideal slope for a plot such as that of FIG. 5 can be determined. Since the slope is equal to the diameter of the ring gear divided by the diameter of the sun gear, relative sizes of the gears of the planetary differential can readily be calculated.

The foregoing explanation is based upon a simple epicyclic planetary gear train. It would also be within the scope of the present invention to utilize a stepped planetary gear train. Such a gear train would broaden the options, afford new characteristics and increase the flexibility of the present invention.

It will be appreciated by one skilled in the art that it would not be practical to make the brake assembly 17 large enough to meaningfully dissipate the kinetic energy of the vessel during an emergency reverse. Nevertheless, since the screw 19 is less than a perfect turbine when windmilling during an emergency reverse, this fact could be capitalized upon by applying brake assembly 17 without regard to damage thereto on a one-time only emergency reverse basis, to slow the windmilling of the screw 19 more rapidly so that the exhaust gasses from the gas generator 1 could be introduced into the second turbine 25 sooner. In this way, the windmilling could be stopped more quickly and the screw could begin to turn in the proper reverse direction just as soon as possible. Such an extreme emergency reverse could be managed by computer 61, upon receipt of a proper extreme emergency input signal from the bridge.

In point of fact, because of the differential, both brakes 16 and 17 must be judiciously applied simultaneously (quickly and carefully under real time control management by computer 61 having received a proper extreme emergency input signal from the bridge) in order to achieve the objective of stopping first turbine 21 and slowing the backspin of second turbine 25. The backspin of second turbine 25 was generated by a controlled release of brake 17 along with a application of brake 16. Both brakes 16 and 17 must be continually modulated to absorb maximum energy from screw 19. This is again fortuitous, as there are now two brakes at work and twice the energy can be dissipated before brake destruction. The computer 61 must save enough effectiveness in brake 16 to allow it to bring first turbine 21 to a total stop long enough to engage lock 16*a*. Brake 17 may be run to destruction to complete the transition to effective reverse as quickly as possible. Computer 61 must only allow brake energy absorption to cancel backspin. If brake 17 is allowed to absorb energy in the normal operating direction of second turbine 25, it is working against the gas generator 1 and negating a portion of its output.

Modifications may be made in the invention without departing from the spirit of it.

We claim:

1. A reversing marine drive comprising a gas generator prime mover provided with first and second counter-rotating power turbines, a ship shaft, a screw on said shaft and a pinion and reduction gear assembly for said ship shaft, a differential gear set means for connecting said first power turbine to said pinion and reduction gear assembly and for disconnecting said second power turbine therefrom to drive said screw in a forward thrust direction and for connecting said second power turbine to said pinion and reduction gear set and disconnecting said first power turbine therefrom to drive said screw in a reverse thrust direction, first and second brake set means being operatively connected to said first and second power turbines, respectively, for stopping said second power turbine when said first power turbine is driving said screw and for stopping said first power turbine when said second power turbine is driving said screw, a master control computer means for monitoring gas generator parameters and for controlling both said gas generator and said brake set means in response to command inputs, interlock means for inhibiting a power setting above idle when both said first and second brake set means are released and for inhibiting release of said first and second brake set means when the power setting of said gas generator is above idle.

2. A reversing marine drive comprising a gas generator prime mover provided with first and second counter-rotating power turbines, a ship shaft, a screw on said shaft and a pinion and reduction gear assembly for said ship shaft, a differential gear set means for connecting said first power turbine to said pinion and reduction gear assembly and for disconnecting said second power turbine therefrom to drive said screw in a forward thrust direction and for connecting said second power turbine to said pinion and reduction gear set and disconnecting said first power turbine therefrom to drive said screw in a reverse thrust direction, first and second brake set means being operatively connected to said first and second power turbines, respectively, for stopping said second power turbine when said first power turbine is driving said screw and for stopping said first power turbine when said second power turbine is driving said screw, a stationary support surrounded by and coaxial with said first power turbine, bearings for said first power turbine mounted on said support, said second power turbine being coaxial with and surrounding said first power turbine, bearings for said second power turbine being mounted on said first power turbine, whereby said bearings for said second power turbine will be in motion when said ship is under way forward and reverse and said bearings for said first power turbine will be stopped when said ship is under way, when in reverse only.

3. The reversing marine drive claimed in claim 2 wherein said differential gear set is a planetary gear set comprising a sun gear, a ring gear, planetary gears and a planetary gear carrier, said first power turbine being operatively connected to said sun gear by a spool shaft, said sun gear having a shaft to which said first brake set means is operatively attached for stopping and releasing said sun gear and said first power turbine, said second power turbine being operatively connected to said ring gear by a drum shaft, said ring gear having a shaft to which said second brake set means is operatively attached for stopping and releasing said ring gear and said second power turbine, said planet carrier having a shaft operatively connected to and driving said pinion gear of said pinion and reduction gear set to drive said ship shaft and said screw.

4. The reversing marine drive claimed in claim 2 including locking means associated with each of said first and second brake set means for releasably locking its respective one of said first and second power turbines against rotation so that its respective brake set means need not be actuated for long periods of time,

5. The reversing marine drive claimed in claim 4 including a bypass valve assembly means for causing some at least of the output of said gas generator to bypass said power turbines and pass to exhaust and for controlling the amount of output passing to exhaust.

6. The reversing marine drive claimed in claim 5 wherein said second power turbine is coaxial with and surrounds said first power turbine and wherein said second power turbine has an entry end and said gas generator has an outlet adjacent thereto, a seal shiftable between a retracted position spaced from said second power turbine entry end and said gas generator outlet and an extended position sealingly engaging said entry end of said second power turbine and said gas generator outlet, and means to shift said seal to said retracted position when said second power turbine is rotating and said first power turbine is stationary, and to shift said seal to said extended position when said second power turbine is stationary and said first power turbine is rotating.

7. The reversing marine drive claimed in claim 6 including a master control means for controlling said gas generator, said brake set means, said locking means, said bypass valve assembly means and said shiftable seal in response to command inputs.

8. The reversing marine drive claimed in claim 7 including interlock means for inhibiting power settings above idle when both said first and second brake set means are released.

9. The reversing marine drive claimed in claim 8 including interlock means for inhibiting release of said first and second brake set means when the power setting of said gas generator is above idle.

10. The reversing marine drive claimed in claim 7 including interlock means for inhibiting release of said first and second brake set means when the power setting of said gas generator is above idle.

11. A reversing marine drive comprising a gas generator prime mover provided with first and second counter-rotating power turbines, a ship shaft, a screw on said shaft and a pinion and reduction gear assembly for said ship shaft, a differential gear set means for connecting said first power turbine to said pinion and reduction gear assembly and for disconnecting said second power turbine therefrom to drive said screw in a forward thrust direction and for connecting said second power turbine to said pinion and reduction gear set and disconnecting said first power turbine therefrom to drive said screw in a reverse thrust direction, first and second brake set means being operatively connected to said first and second power turbines, respectively, for stopping said second power turbine when said first power turbine is driving said screw and for stopping said first power turbine when said second power turbine is driving said screw, said second power turbine being coaxial with and surrounding said first power turbine, said second power turbine having an entry end and said gas generator having an outlet adjacent thereto, a seal shiftable between a retracted position spaced from said second power turbine entry end and said gas generator outlet and an extended position sealingly engaging said entry end of said second power turbine and said gas generator outlet, and means to shift said seal to said retracted position when said second power turbine is rotating and said first power turbine is stationary, and to shift said seal to said extended position when said second power turbine is stationary and said first power turbine is rotating.

12. A reversing marine drive comprising a gas generator prime mover provided with first and second counter-rotating power turbines, a ship shaft, a screw on said shaft and a pinion and reduction gear assembly for said ship shaft, a differential gear set means for connecting said first power turbine to said pinion and reduction gear assembly and for disconnecting said second power turbine therefrom to drive said screw in a forward thrust direction and for connecting said second power turbine to said pinion and reduction gear set and disconnecting said first power turbine therefrom to drive said screw in a reverse thrust direction, first and second brake set means being operatively connected to said first and second power turbines, respectively, for stopping said second power turbine when said first power turbine is driving said screw and for stopping said first power turbine when said second power turbine is driving said screw, a bypass valve assembly means for causing some at least of the output of said gas generator to bypass said power turbines and pass to exhaust and for controlling the amount of said output passing to exhaust.

13. A reversing marine drive comprising a gas generator prime mover provided with first and second counter-rotating power turbines, a ship shaft, a screw on said shaft and a pinion and reduction gear assembly for said ship shaft, a differential gear set means for connecting said first power turbine to said pinion and reduction gear assembly and for disconnecting said second power turbine therefrom to drive said screw in a forward thrust direction and for connecting said second power turbine to said pinion and reduction gear set and disconnecting said first power turbine therefrom to drive said screw in a reverse thrust direction, first and second brake set means being operatively connected to said first and second power turbines, respectively, for stopping said second power turbine when said first power turbine is driving said screw and for stopping said first power turbine when said second power turbine is driving said screw, locking means associated with each of said first and second brake set means for releasably locking its respective one of said first and second power turbines against rotation so that its respective brake set means need not be actuated for long periods of time.

* * * * *